US010766504B2

(12) United States Patent
Cecchi

(10) Patent No.: US 10,766,504 B2
(45) Date of Patent: Sep. 8, 2020

(54) FLOOR STRUCTURE PROVIDED WITH A FIRE PROTECTION SYSTEM FOR RAILWAY VEHICLES

(71) Applicant: HITACHI RAIL S.p.A., Naples (IT)

(72) Inventor: Carlo Cecchi, Naples (IT)

(73) Assignee: HITACHI RAIL S.p.A., Naples (IT)

( * ) Notice: Subject to any disclaimer, the term of this patent is extended or adjusted under 35 U.S.C. 154(b) by 230 days.

(21) Appl. No.: 15/745,609

(22) PCT Filed: Jul. 28, 2016

(86) PCT No.: PCT/IB2016/054530
§ 371 (c)(1),
(2) Date: Jan. 17, 2018

(87) PCT Pub. No.: WO2017/017642
PCT Pub. Date: Feb. 2, 2017

(65) Prior Publication Data

US 2018/0215398 A1 Aug. 2, 2018

(30) Foreign Application Priority Data

Jul. 28, 2015 (IT) ..... 102015000039111

(51) Int. Cl.
*B61D 17/10* (2006.01)
*B61F 1/08* (2006.01)

(52) U.S. Cl.
CPC ..... *B61D 17/10* (2013.01); *B61F 1/08* (2013.01)

(58) Field of Classification Search
CPC ..... B61D 13/00; B61D 17/00; B61D 17/04; B61D 17/041; B61D 17/10; B61D 17/18; B61D 49/00
See application file for complete search history.

(56) References Cited

U.S. PATENT DOCUMENTS

2014/0238262 A1* 8/2014 Bigras ..... B61D 17/10 105/422

FOREIGN PATENT DOCUMENTS

| | | |
|---|---|---|
| EP | 2 689 986 | 1/2014 |
| WO | WO 2007/014340 | 2/2007 |
| WO | WO 2008/135190 | 11/2008 |

* cited by examiner

*Primary Examiner* — Robert J McCarry, Jr.
(74) *Attorney, Agent, or Firm* — Leason Ellis LLP

(57) ABSTRACT

A floor structure is provided with an underframe, which is part of a carriage body, is elongated along a longitudinal axis coinciding with the advancement axis of such carriage, and has a plurality of longitudinal attachment rails arranged on an area of the lower surface of the underframe; the attachment rails project downwards so as to define therebetween a plurality of compartments, which are engaged by panels having insulating material to form a fire protection system; such a system has, furthermore, a plurality of section bars, which are attached to the attachment rails and are shaped so as to retain the panels in fixed positions in the compartments and, at the same time, cover the attachment rails.

10 Claims, 6 Drawing Sheets

FLOOR STRUCTURE PROVIDED WITH A FIRE PROTECTION SYSTEM FOR RAILWAY VEHICLES

CROSS-REFERENCE TO RELATED PATENT APPLICATIONS

This application is a U.S. National Phase Application under 35 U.S.C. § 371 of International Patent Application No. PCT/IB2016/054530, filed Jul. 28, 2016, which claims the priority of Italian Application No. 102015000039111, filed Jul. 28, 2015, which is incorporated by reference as if expressly set forth in its entirety herein.

TECHNICAL FIELD

The present invention relates to a floor structure provided with a fire protection system for railway vehicles.

BACKGROUND ART

As is known, railway and subway carriages each have a body or shell provided with an underframe which defines the base for the inner floor of the carriage itself. Normally, the underframe must meet technical standards and specifications relating to fire resistance, particularly resistance to fire (REI) of 30 minutes. To meet these requirements, especially when the underframe is made of aluminium, its lower surface is coated with intumescent paint, applied by using spraying technology.

This solution, though widely used, must be performed in specific areas equipped for painting operations and requires high line crossing times in the production cycle.

US2014238262 describes a solution according to the preamble of claim 1, where the fire protection system is defined by a panel with insulating material fixed to the underframe.

DISCLOSURE OF INVENTION

The object of the present invention is to provide a floor structure provided with a fire protection system for railway vehicles, which makes it possible in a simple and economical manner to solve the problems described above, has the necessary fire resistance characteristics and can be assembled in a relatively simple manner.

According to the present invention a floor structure is provided with a fire protection system for railway vehicles, as defined in claim 1.

BRIEF DESCRIPTION OF THE DRAWINGS

The invention will now be described with reference to the accompanying drawings, which illustrate a non-limiting embodiment thereof, in which.

BEST MODE FOR CARRYING OUT THE INVENTION

Figure 1:
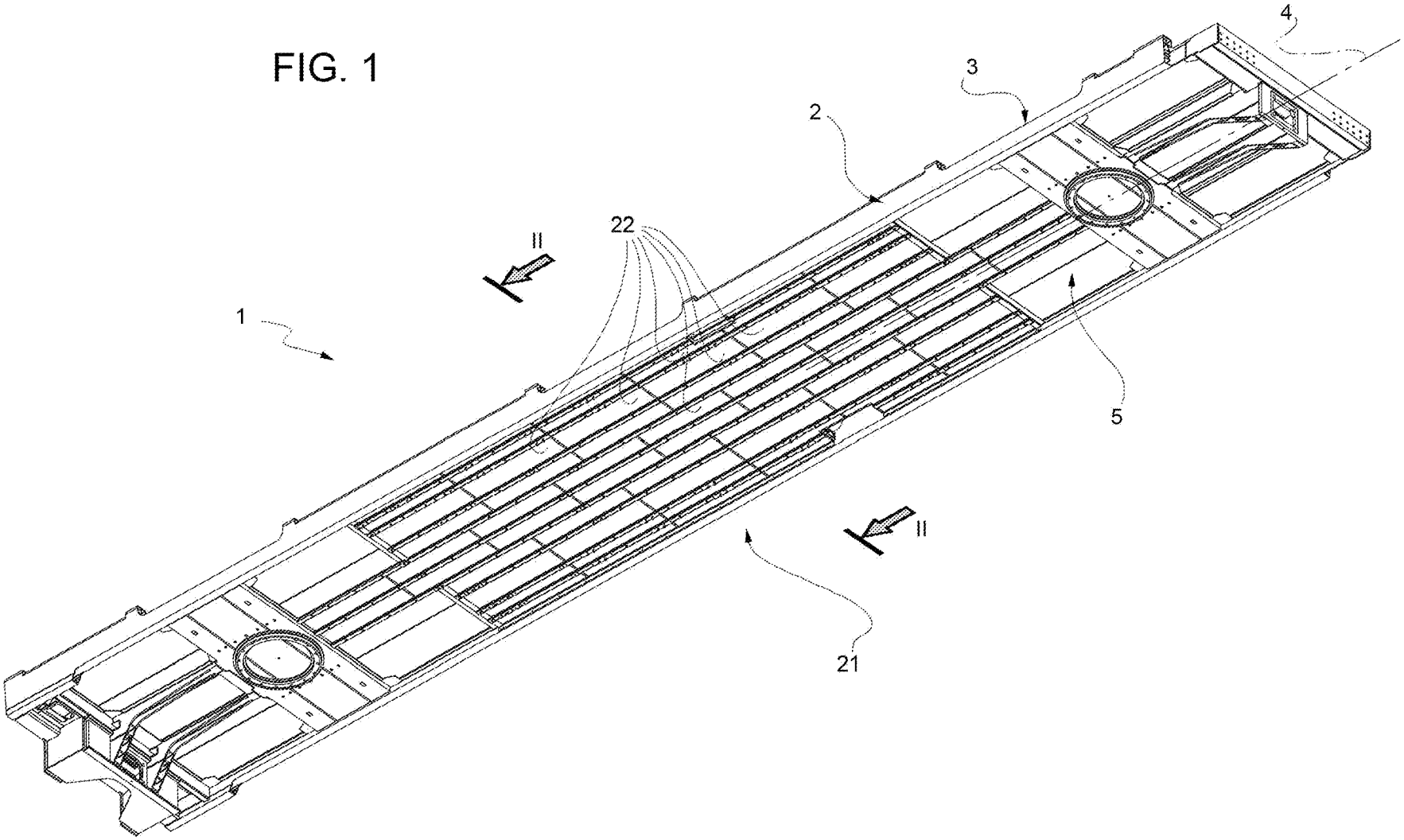
FIG. 1 shows, in perspective from below and partially, a preferred embodiment of the floor structure provided with a fire protection system for railway vehicles according to the present invention.

In FIG. 1, reference numeral 1 denotes a floor structure of a railway vehicle, i.e. a train or a subway. The structure 1 comprises an underframe or platform 2, which is part of a body or shell of a carriage of the vehicle and has a top surface 3 supporting or defining an inner floor (not illustrated) of such carriage.

The underframe 2 is elongated along a straight longitudinal axis 4 which corresponds to the longitudinal axis of advancement of the railway vehicle. The underframe 2 has a lower surface 5 opposite the surface 3 and comprises a plurality of attachment tracks or rails 10 (FIG. 2), commonly referred to as "rails", and arranged in correspondence with an intermediate area of the surface 5. In particular, such intermediate area is located centrally along the axis 4 and occupies the entire width of the underframe 2 (i.e. extends from one lateral end to the other).

Figure 2:
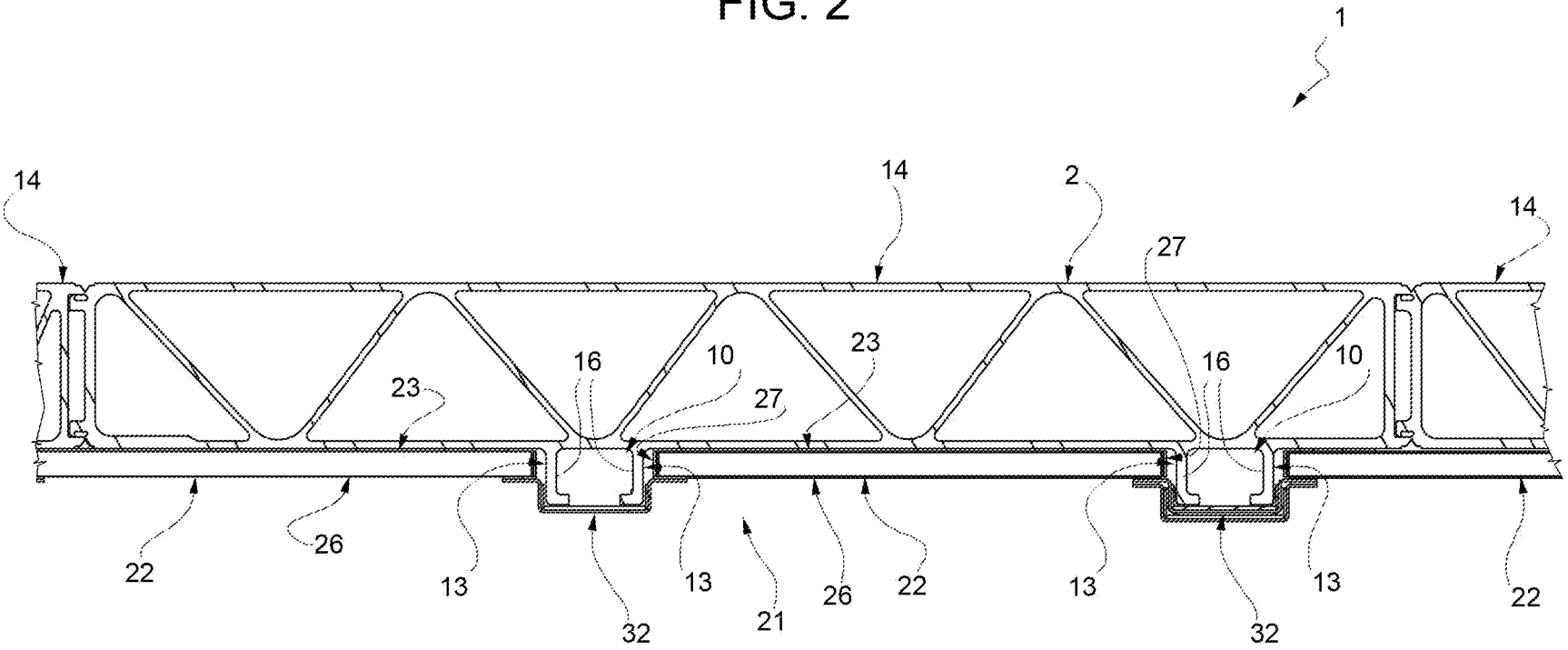
FIG. 2 shows in a simplified manner and on an enlarged scale, a cross-section of the floor structure according to the vertical cross-section plane indicated by the line II-II in FIG. 1.

With reference to the cross-section in FIG. 2, the attachment rails 10 are parallel to the axis 4 and are normally used to attach one or more supports 12 (FIG. 5) to which the so-called underframe equipment (not shown)—for example the container for the batteries, the inverter, the rheostat, etc.—is then coupled.

The attachment rails 10 are defined by downward protrusions so as to horizontally define therebetween a plurality of compartments 13.

In particular, the underframe 2 is composed of extruded elements 14 made of aluminium alloy, so that the attachment rails 10 constitute part of the extruded elements 14.

Figure 4:
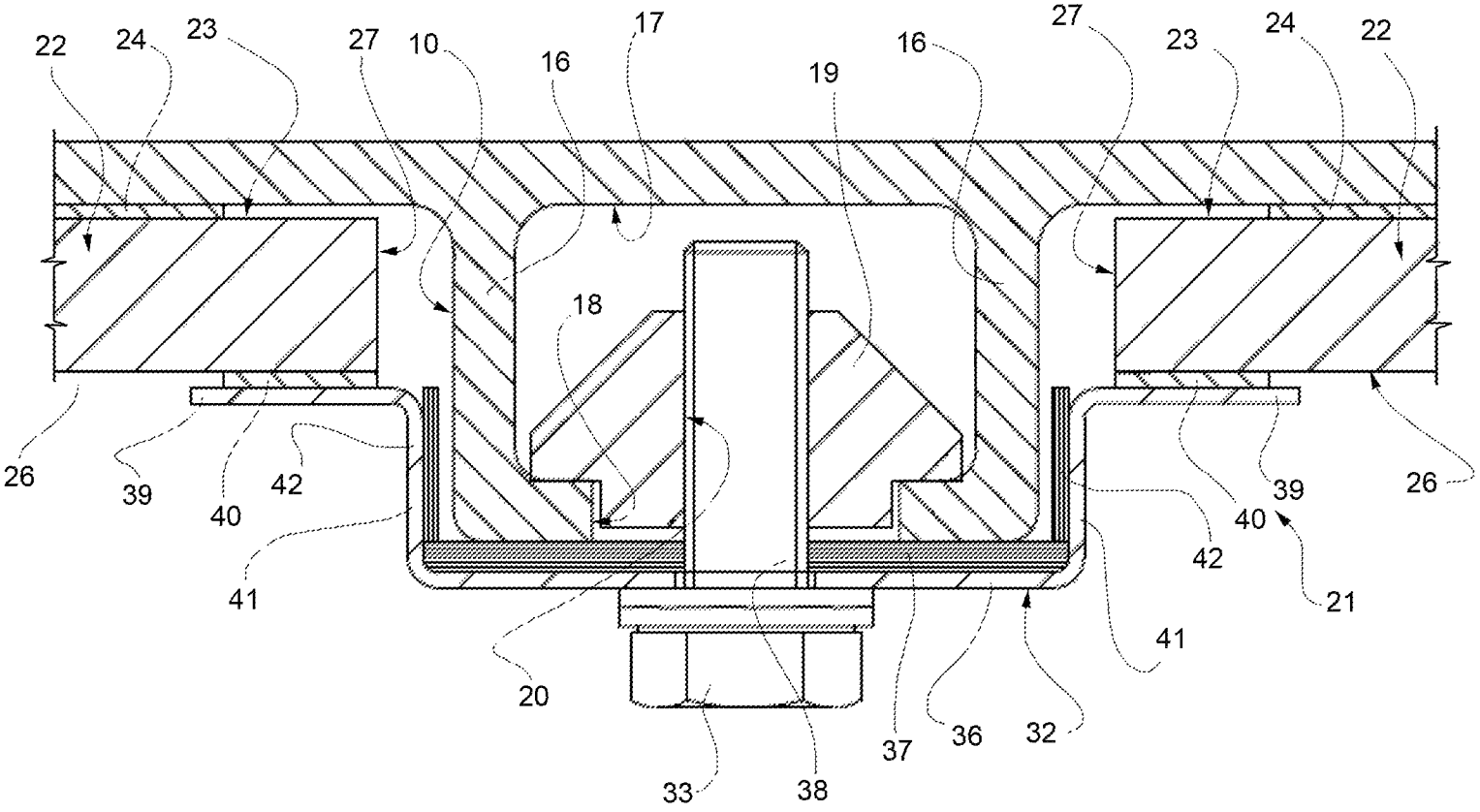
FIGS. 4 and 5 show two details of the floor structure of FIG. 2, again in cross-section.

In particular, as may be seen in FIG. 4, each attachment rail 10 comprises two vertical appendages 16, substantially L-shaped and defining therebetween a longitudinal channel 17, substantially T-shaped. The channel 17 is thus open towards the bottom at a longitudinal slit 18, defined by the ends of the appendages 16. The channel 17 of each attachment rail 10 houses a plurality of attachment elements 19, each of which has at least one threaded hole 20, vertically aligned with the slit 18, and longitudinally sliding in the channel 17 to adjust the position of the hole 20 and of a sufficiently large size not to come out through the slit 18.

Returning to FIGS. 1 and 2, the floor structure 1 comprises a fire protection system 21, which covers at least a part of the surface 5 and comprises a plurality of panels 22 arranged in the compartments 13.

Each panel 22 has a width such as to nearly fill the compartment 13, i.e. the transverse space between two adjacent attachment rails 10.

The thickness of the panels 22 is less than the height of the appendages 16, so as not to protrude beyond the attachment rails 10, in order not to interfere with any equipment or components (brackets, ducts etc.), not illustrated, to be subsequently fitted to the carriage in the underbody area.

Figure 3:
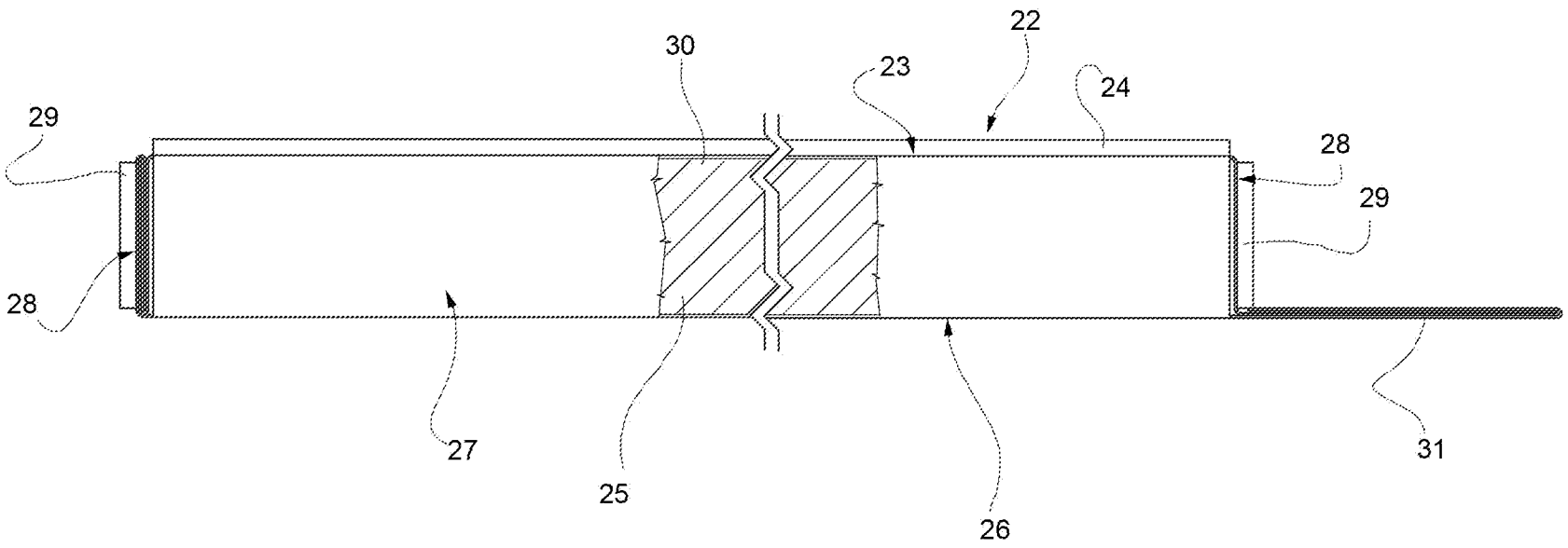
FIG. 3 is a side view of a component of FIG. 2, on a further enlarged scale and with parts removed for clarity.

With reference to FIG. 3, each panel 22 has a surface 23, which is facing upwards, is flat and is coupled to the surface 5 with the interposition of sealing strips 24, preferably made of a silicone, closed cell, foam-based material.

According to one aspect of the present invention, each panel 22 comprises a tank or container 25, in stainless steel sheet, with relatively low thickness, for example less than 0.5 mm (in particular equal to 0.3 mm). The container 25, in particular, has a substantially parallelepiped outer shape, and has: a surface 26 facing downwards; two side faces 27, which are opposite each other and are facing towards respective attachment rails 10; and two end faces 28, facing towards the faces 28 of adjacent panels 22.

The length of the container 25 is sized so as to fill each compartment 13 by means of a series of aligned panels 22, all having the same length. In other words, this way the length of the panels 22 is standardised to optimise the management of warehouse stocks (to reduce the raw material codes to be managed). In particular, the standard length of the container 25 is between 1150 and 1200 mm, so as to compromise between the need to minimise the number of aligned panels to be installed in each compartment 13 and the need to adapt to different lengths of compartment 13.

Advantageously, the surface 26 has an embossed appearance or finish (FIG. 6) to improve its rigidity.

Each container 25 is closed on all six sides, so that even the surface 23 is defined by a sheet of the container 25.

In particular, for at least some of the panels 22, the container 25 comprises two metal half-shells which are attached to each other so as to completely enclose the insulating material therebetween. In particular, the two half-shells have a C-shaped cross-section and/or the container 25 is composed solely of the two half-shells.

Between the faces 28 of adjacent panels 22 at least one strip or gasket 29 is interposed consisting of intumescent material, i.e. material which expands above an activation temperature, for example a temperature of 200° C.

Each panel 22 further comprises a core or nucleus 30, commonly called "core", arranged in the housing defined by the container 25, in such a way as to completely fill such housing, and consisting of high capacity thermal and fire insulation material (in particular, low thermal conductivity at high temperatures). Such material can be found commercially and chosen according to the fire protection and thermal insulation specifications to be met. Preferably, a material indicated by the trade name FIREMASTER® Marine Plus is used.

Some of the panels 22 comprise a tab 31, which is defined by sheet in the same material as the container 25, protrudes horizontally and longitudinally with respect to one of the faces 28 and is substantially flush with the surface 26 so as to overlap an adjacent panel 22 to cover any empty space between the faces 28 of two panels 22 arranged consecutively with each other in the same compartment 13. In particular, the tab 31 constitutes part of a bracket which is L-shaped and defines the aforesaid face 28. Thanks to the tab 31, the continuity of the fire protection system is guaranteed.

With reference to FIG. 4, the fire protection system 21 further comprises a plurality of section bars 32, which are made of stainless steel, and are attached to the attachment rails 10 by metal mechanical elements 33, for example screws. The section bars 32 are shaped so as to retain the panels 22 in fixed positions in the compartments and, at the same time, to cover the bottom of the attachment rails 10, in order to ensure fire protection of the rails themselves. It follows that the section bars 32 also cover any gaps between the attachment rails 10 and the side faces 27.

The sealing strips 24 are carried, in fixed positions, by the surface 23. During assembly, the sealing strips 24 are kept in contact with the underframe 2 until the section bars 32 are attached to the attachment rails 10 by means of the elements 33.

The cross-section of the section bars 32 is an open section having a shape of an upside-down omega, and comprises an intermediate wall 36, which is substantially horizontal and is placed under the corresponding attachment rail 10.

The upper surface (i.e., the inner surface) of the wall 36 is completely covered by a strip of fire barrier material 37, in particular in a muscovite or phlogopite-based material, which therefore remains interposed between the wall 36 and the attachment rail 10.

The wall 36 and the strip 37 are provided with at least one hole 38 which, in the vertical direction, is a through hole and is aligned with a corresponding hole 20. At the same time, the elements 33 are defined by respective screws, which engage the holes 38 and are screwed into the holes 20 to lock the section bar 32 to the attachment rail 10.

The cross-section of the section bars 32 ends laterally with two flanges or fins 39, which are opposite to each other, are substantially horizontal and are supported on the lateral ends of the surface 26, preferably by means of the interposition of respective sealing strips 40, similar to the sealing strips 24.

Again considering the cross-section of the section bar 32, the two fins 39 are joined to the lateral longitudinal edges of the wall 36 by means of respective walls 41, which are arranged on opposite sides of the attachment rail 10 and are substantially vertical.

The inner surfaces of the walls 41 are covered by respective strips or gaskets 42 of intumescent material, similar to that of the strips 29. The strips 42 are facing, and preferably spaced, with respect to the sides of the attachment rail 10, to enable the expansion of the intumescent material in the event of exposure to fire.

Figure 6:
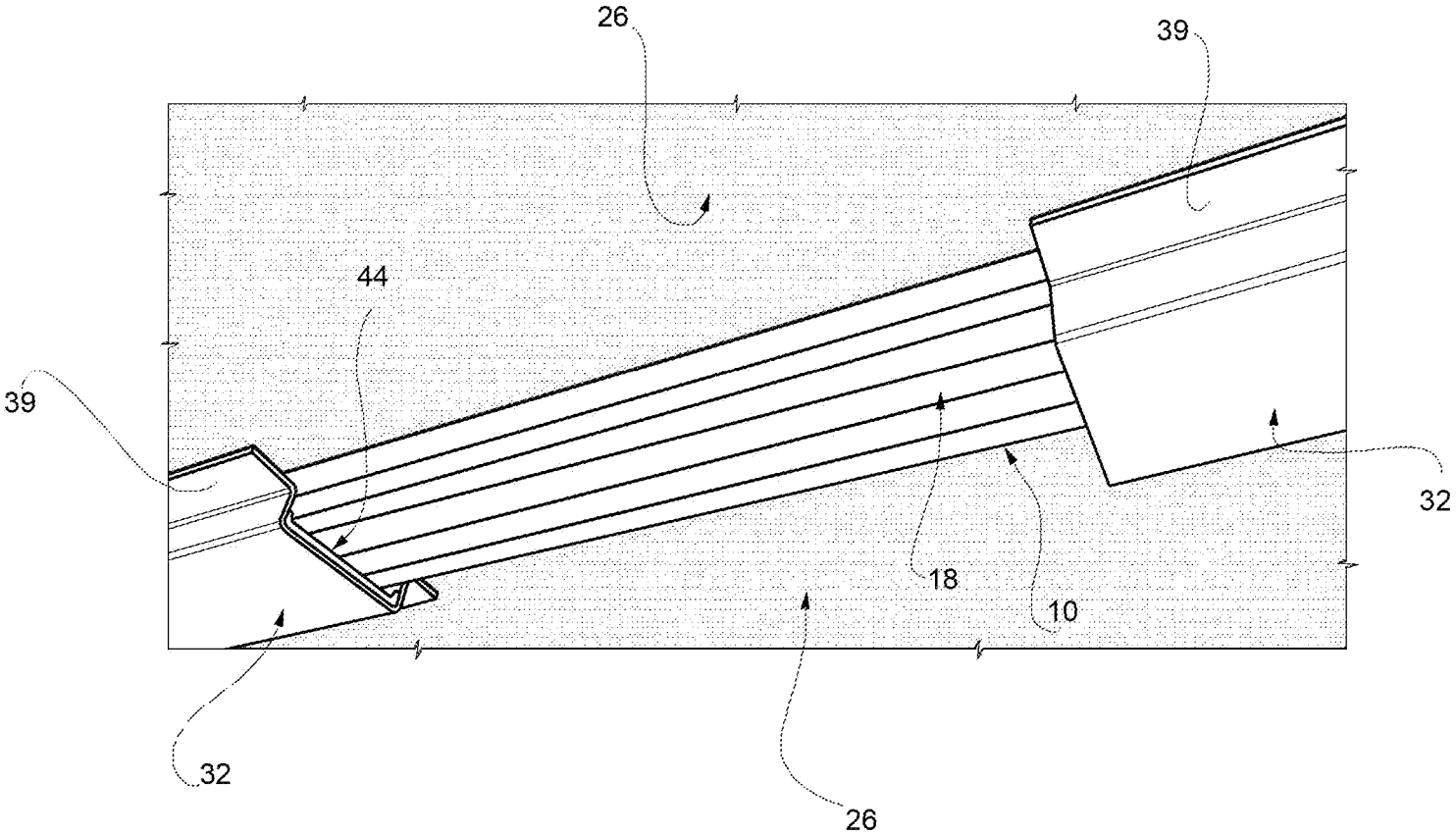
FIG. 6 illustrates, in perspective and with parts removed for clarity, a detail of FIGS. 2 and 5.

With reference to FIG. 6, at the area where the support 12 is to be fixed, the attachment rail 10 is devoid of the section bar 32. In other words, the attachment rail 10 carries two section bars 32 which are spaced longitudinally from each other so as to leave an interruption or opening 44 therebetween at such area.

Figure 5:
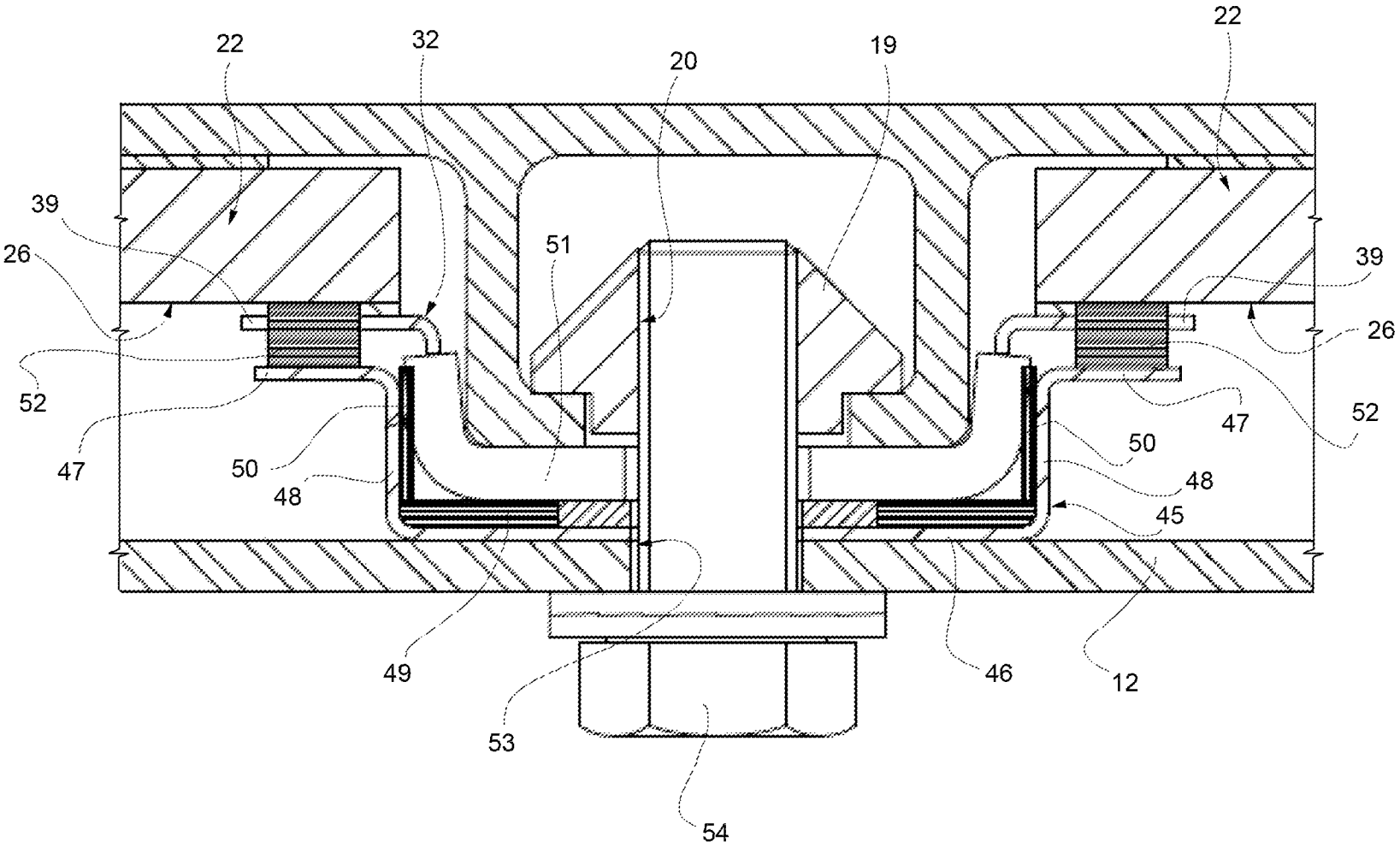

As seen in FIG. 5, the opening 44 is closed by an additional closure section bar 45, the cross-section of which has also the shape of an upside-down omega, with an intermediate wall 46, with two opposite end fins 47 and with two walls 48 which join the fins 47 to the lateral longitudinal edges of the wall 46.

The longitudinal ends of the section bar 45 are superposed and coupled to the longitudinal ends of the two section bars 32 visible in FIG. 6, so as to close any empty space by means of sealing gaskets, similar to the strips 24.

In this area, a spacer, defined by a U-bolt 51 in U-shaped stainless steel, is interposed between the attachment rail 10 and the section bar 45. The U-bolt 51 and the wall 46 are provided with at least one hole 53 which, in the vertical direction, passes through and is aligned with a corresponding hole 20. The hole 53 is engaged by a screw 54 which is screwed into such hole 20, to keep the support 12 stationary against the wall 46 and, thus, block both the section bar 45 and the support 12 to the attachment rail 10.

Between the upper surface of the wall 46 and the U-bolt 51 a strip or gasket 49 is provided, made of fire barrier material, for example of fibres embedded in epoxy resin. Between the vertical walls 48 of the section bar 45 and the U-bolt 51 gaskets or strips 50 made of intumescent material similar to that of the strips 42, 29 are interposed.

The upper surfaces of the fins 47 are coated with sealing strips 52 similar to the strips 40, but generally of greater thickness, so as to cover the greater distance from the surface 26 of the panels 22.

Along the side edges of the underframe 2 (not shown), suitable expedients (not illustrated) are used to ensure the sealing and the resistance to fire of any spaces between the panels 22 and said edges.

During assembly, the underframe 2 is coated with the fire protection system 21, arranging the panels 22 in the compartments 13 and then attaching the section bars 32, 45. The assembly of the fire protection system 21 can be performed while keeping the underframe 2 in the tilted, upside-down position before assembling the vehicle body, or after assembling said body working from below the surface 5.

It is evident from the above how the operations for coating the underframe 2 with the fire protection system 21 do not require painting along assembly lines and can be carried out quickly and easily without any special specific equipment.

In particular, the realization of the panels 22 and any treatments of the panels 22 and/or of the section bars 32, 45 (including any painting operations) can be performed outside the assembly lines, so that the latter tend to be simpler compared to the prior solutions. Furthermore, it is possible to standardise the size of the panels 22 to make this solution as modular as possible.

Moreover, no changes are made to the conventional underframes, which correspond exactly (in terms of configuration, characteristics and dimensional proportions) to the underframe 2 shown by way of example. In particular, to stably attach the panels 22 the attachment rails 10 are used, which are already provided in the known underframes.

At the same time, the fire protection system makes it possible to obtain excellent performance as regards fire resistance without excessively increasing the weight of the vehicle.

Furthermore, the number of components of the fire protection system 21 is relatively low, both because the dimensions of the panels 22 are standardised, and because the section bars 32 perform a dual function, i.e. allow the attachment of the panels 22 and cover the attachment rails 10.

From the above, lastly it appears evident that modifications and variations may be made to the floor structure 1 described with reference to the appended drawings while remaining within the sphere of protection of the present invention as defined in the appended claims.

In particular, the entire length of a compartment 13 may be occupied by a single panel, instead of providing a plurality of panels 22 placed alongside each other; and/or the attachment rails 10 may have a cross-section with a shape different to that shown by way of example.

Even the shape of the cross-sections of the section bars 32 and 45 may be different from those shown, depending on the vertical thickness of the panels 22 and/or depending on the height and the shape of the attachment rails 10.

The invention claimed is:

1. A floor structure for a railway vehicle, the floor structure comprising:

an underframe that is elongated along a longitudinal axis, coincident with an advancement axis of the railway vehicle; the underframe comprising a lower surface and a plurality of attachment rails arranged at least on an area of said lower surface; the attachment rails being parallel to said longitudinal axis and projecting downwards from said area, so as to define a plurality of compartments horizontally between said attachment rails;

a fire protection system that covers said area;

said fire protection system comprising:

a plurality of panels arranged in said plurality of compartments;

a plurality of section bars fixed to said attachment rails; said plurality of section bars being shaped so as to retain said plurality of panels in fixed positions in said compartments and, simultaneously, cover said attachment rails;

wherein each of said panels comprises a respective metal container and respective insulating material;

wherein said metal containers are closed containers containing the insulating material.

2. The floor structure according to claim 1, wherein said closed containers and said section bars are made of stainless steel.

3. The floor structure according to claim 1, wherein all said closed containers have the same length.

4. The floor structure according to claim 1, wherein said closed containers have a lower surface that is embossed.

5. The floor structure according to claim 1, wherein said section bars are fastened to said attachment rails metal mechanical elements.

6. The floor structure according to claim 1, wherein each said section bar comprises respective intermediate wall, which is substantially horizontal; each of said intermediate walls being arranged under a respective one of said attachment rails and having an upper surface covered by a strip of fire barrier material.

7. The floor structure according to claim 1, wherein all of said closed containers have the same width, less than the distance between two adjacent attachment rails.

8. The floor structure according to claim 1, wherein said closed containers have a height less than that of said attachment rails and wherein said section bars have an upside-down omega-shaped cross-section.

9. The floor structure according to claim 1, wherein said underframe is composed of extruded elements made in aluminium alloy, and wherein said attachment rails constitute part of said extruded elements.

10. The floor structure according to claim 1, wherein, for at least some of said panels, each of said closed containers is formed by two half-shells which are attached to one another so as to fully enclose the insulating material.

* * * * *